United States Patent [19]

Andersson

[11] 4,261,057

[45] Apr. 14, 1981

[54] DISPOSABLE BIB AND A METHOD FOR ITS MANUFACTURE

[75] Inventor: Karl G. B. Andersson, Halmstad, Sweden

[73] Assignee: Duni Bila AB, Sweden

[21] Appl. No.: 16,345

[22] Filed: Feb. 28, 1979

[30] Foreign Application Priority Data

Mar. 6, 1978 [SE] Sweden ..... 7802514

[51] Int. Cl.[3] ..... A41B 13/10

[52] U.S. Cl. ..... 2/49 R

[58] Field of Search ..... 2/49 A, 49 R, 50

[56] References Cited

U.S. PATENT DOCUMENTS

| | | | |
|---|---|---|---|
| D. 238,521 | 1/1976 | Andersson | 16/49 A |
| 2,425,961 | 8/1947 | Shattuck | 16/49 R |
| 2,580,388 | 1/1952 | Allen | 16/49 R |

FOREIGN PATENT DOCUMENTS

| | | | |
|---|---|---|---|
| 715557 | 9/1954 | United Kingdom | 2/49 R |

*Primary Examiner*—Doris L. Troutman

*Attorney, Agent, or Firm*—Ostrolenk Faber, Gerb & Soffen

[57] ABSTRACT

The disclosure concerns a disposable bib. The bib is formed of a rectangular sheet of foldable paper or the like. One end is folded up to define a pocket and the side edges of the folded up section are bonded to the side edges of the sheet. The side edges of the sheet are folded inwardly before the end of the sheet is folded up, thereby defining a gusset at the attached side edges, which gusset permits the pocket to be opened outwardly.

7 Claims, 3 Drawing Figures

DISPOSABLE BIB AND A METHOD FOR ITS MANUFACTURE

The present invention relates to a disposable bib consisting of a rectangular sheet of material, e.g. plastics-coated tissue paper, one end of which is folded back and bonded to the side edges of the sheet by means of gluing or welding to form a collecting pocket.

With this type of bib it has so far been found relatively difficult to open out the bib in a quick and simple fashion, and put it on the wearer so that when in use the collecting pocket on the bib serves its purpose, and stands out so that it can collect possible spilt food, which is not absorbed by the material of the bib itself. Furthermore, these bibs are difficult to handle due to their size.

The object of the present invention is to remove the disadvantages found with this type of disposable bib and to provide a bib which essentially distinguishes itself in that before the folding back of the pocket-forming portion and the bonding of it to the side edges, the sheet is provided with a double fold or pleat, on either side of a theoretical centre line dividing the sheet into two symmetrical halves along its length, to form two opposing folds parallel to the centre line, between a first and a second folding line having mutual spacing which determines the amount of opening of the future pocket, said pocket opens out automatically and remaining open after the folds or pleats, thus formed have been pulled out and the bib given full use width.

Thanks to the invention a disposable bib is now obtained which serves its purpose excellently, while it is simple and cheap to manufacture even so. From the point of view of production, a considerable increase in capacity is gained, due to the special longitudinal folding of the bib, since more parallel products can be handled in the cross-folding station with its existing width, there being thus achieved a lower production cost than what is the case with conventional disposable bibs. The narrow width of the longitudinally folded product also has large advantages in handling on preparation tables and trolleys where space is limited. Handling the bib when putting it to use is simple, since the pleat is pulled out with a simple movement and the product rapidly extended to its full use width. The pleats are securely retained in place during transport and handling in the state they are folded for delivery. One using bibs, and perhaps especially nursing personnel, perhaps finds the most prominent characteristic of the bib according to the present invention to be that the central pleats result in that the collecting pocket of the bib opens automatically due to the method of folding. By this is meant that an initial opening is formed when the pleats are opened out, and this opening simplifies in an obvious way the operation of shaping up the collecting pocket of the bib, if this should be found necessary.

Figure 1:
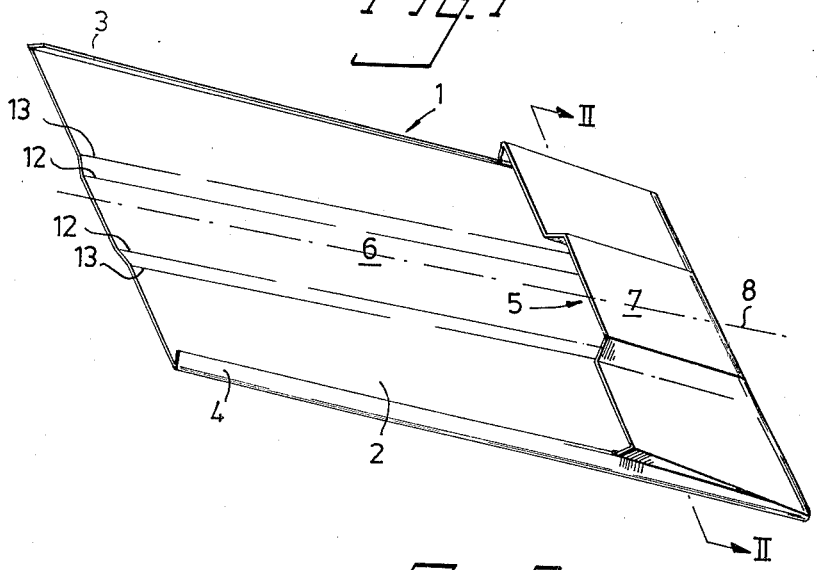
Figure 2:
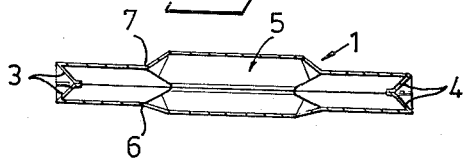
Figure 3:
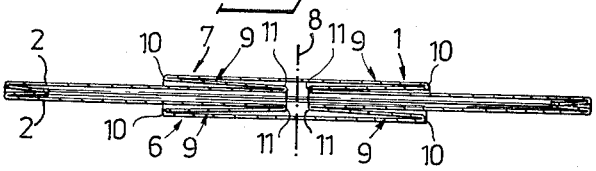

The invention will now be described in detail while referring to the attached drawing, on which FIG. 1 is a perspective view of a disposable bib in accordance with the invention, FIG. 2 is a section along the line II—II of the disposable bib in FIG. 1, to a somewhat reduced scale, and FIG. 3 is a section through the bib along the same line II—II, but when the bib in its unextended condition, and to a somewhat enlarged scale.

The disposable bib 1 illustrated as an example in FIGS. 1, 2 and 3, consists of a rectangular sheet 2 of material, e.g. plastics-coated tissue paper, the longitudinal side edges being folded inwards to form the side edge flaps 3 and 4. One end portion of the sheet 2 is folded back over the main portion 6 and the side edge flaps 3 and 4 to form a collecting pocket 5. The side edge flaps 3 and 4 on the main portion 6 of the bib 1, and the pocket-forming portion 7 are bonded to each other along their free edges by means of gluing or welding, so that when using the bib 1 the side edge flaps 3 and 4 will be pulled out to their position of use after the bib has been pulled out to full width. In use it is also possible to pull out the bib to full width except for the bottom portion of the pocket-forming part 7, while maintaining the same function of the bib.

As is apparent, especially from FIG. 3, the sheet 2 has been provided with a double fold or pleats 9 on either side of the theoretical centre line 8 before the pocket-forming part 7 has been turned back and bonded at the side edge flaps 3 and 4. This centre line 8 divides the sheet 2 longitudinally into two symmetrical halves, and the pleats 9 form two opposing folds 10 and 11 parallel to the centre line 8, between a first 12 and a second folding line 13. The distance between these folding lines 12 and 13 determines the amount of opening of the future collecting pocket 5, when the folds 10 and 11 or the pleats 9 have been pulled out and the bib 1 has been given full use width.

The method of manufacturing a disposable bib 1 of the type described above consists in that the sheet 2 is folded double twice longitudinally, i.e. once on either side of the theoretical centre line 8 dividing the sheet 2 into two equally large parts. The pocket-forming portion 7 is then folded back with the sides of the bib 1 facing outwards which has the pleats 9.

The edge portions of the flaps 3 and 4 of the pocket-portion 7 and the main portion 6 are then bonded together, so that during use a collecting pocket 5 automatically opens out, and remains in its open position after the folds 10 and 11 have been pulled out, the bib thus being given its full use width.

In manufacture, the disposable bib in accordance with the present invention can easily be modified by the length of the pocket-forming portion 7 being made as long as the main portion 6 of the bib 1, thus obtaining a product which is suitable as a pillow cover, where the handling problem, manufacturing technique and advantages with the automatic opening effect in use are the same as for disposable bibs.

I claim:

1. A disposable bib formed from a sheet having a top edge, a bottom edge and opposite side edges;

a pair of double pleats in said sheet extending from said top edge to said bottom edge;

said double pleats each being formed by a plurality of fold lines which in turn define at least one panel in each pleat which is folded toward the longitudinal center of said sheet; said last mentioned panels in each pleat extending toward said longitudinal center of said sheet, facing each other and together defining a space between them along the said longitudinal center of said sheet;

a pocket-forming flap having a top edge, a bottom edge that is continuous and integral with the bottom edge of the sheet, and two side edges secured respectively to said opposite side edges of the sheet, to form a pocket; said flap having a pair of double pleats extending from the top edge to the bottom edge thereof, said pair of double pleats of the flap each extending in an area of said flap corresponding to and overlying the double pleats of said sheet.

2. The bib of claim 1, wherein said space in the sheet along the longitudinal center thereof is narrower than the distance from each side edge to the double pleat; said flap having a corresponding dimension of the spacing between the double pleats thereof.

3. The bib of claim 1, wherein a gusset is provided at each of the side edges of the flap, each gusset connecting one side edge of the flap and the corresponding side edge of the sheet.

4. The bib of claim 1 or claim 2, wherein the flap and pleats are folded in surface to surface relation with said sheet; said flap being rotatable about its bottom edge connection with said sheet to form an open pocket.

5. The bib of claim 1, 2, 3 or 4, wherein the bib is made of a waterproof material.

6. The bib of claim 4, wherein the bib is made of a waterproof material.

7. A method for manufacturing a disposable bib, comprising the steps of:

folding a sheet of material to form two generally longitudinal double pleats therein;

folding the sheet along a line generally transverse to the double pleats to define a folded-up flap; and securing two opposing edges of the folded-up flap to respective corresponding edges of the remaining portion of the sheet to form a pocket;

folding two opposing edges of the sheet generally parallel to the double pleats over one surface of the sheet to form two thin flaps, the folding up of one end of the sheet to form the folded-up flap defines a pocket on the same side of the sheet as the thin flap; the securement of the folded-up flap to the remaining portion of the sheet forms gussets which comprise the thin flap.

* * * * *